US009989066B2

(12) United States Patent
Ghosh et al.

(10) Patent No.: US 9,989,066 B2
(45) Date of Patent: Jun. 5, 2018

(54) LOW POWER AND LOW NOISE FAN-SCROLL WITH MULTIPLE SPLIT INCOMING AIR-STREAMS

(71) Applicant: MAHLE International GmbH, Stuttgart, DE (US)

(72) Inventors: Debashis Ghosh, Williamsville, NY (US); Richard S. Baranowski, Lakeview, NY (US); Shamsuddin Noorani, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 747 days.

(21) Appl. No.: 14/208,916

(22) Filed: Mar. 13, 2014

(65) Prior Publication Data

US 2014/0271166 A1 Sep. 18, 2014

Related U.S. Application Data

(60) Provisional application No. 61/782,092, filed on Mar. 14, 2013.

(51) Int. Cl.

| | |
|---|---|
| ***F04D 29/66*** | (2006.01) |
| ***F04D 29/28*** | (2006.01) |
| ***F04D 29/42*** | (2006.01) |
| ***F04D 29/70*** | (2006.01) |

(52) U.S. Cl.

CPC ..... *F04D 29/282* (2013.01); *F04D 29/4206* (2013.01); *F04D 29/4213* (2013.01); *F04D 29/701* (2013.01)

(58) Field of Classification Search

CPC ..... F04D 29/40; F04D 29/403; F04D 29/42; F04D 29/4206; F04D 29/4213; F04D 29/4226

USPC ..... 415/119

See application file for complete search history.

(56) References Cited

U.S. PATENT DOCUMENTS

| | | | | |
|---|---|---|---|---|
| 5,063,832 | A * | 11/1991 | Mirumachi | B60H 1/00471 415/206 |
| 5,690,470 | A * | 11/1997 | Zimmer | F04D 29/424 415/214.1 |
| 5,813,831 | A * | 9/1998 | Matsunaga | F04D 29/4213 415/173.6 |
| 7,175,398 | B2 | 2/2007 | Kinmartin et al. | |
| 7,381,028 | B2 | 6/2008 | Hancock et al. | |

(Continued)

FOREIGN PATENT DOCUMENTS

EP 0846868 A2 10/1998

*Primary Examiner* — Jason Shanske
*Assistant Examiner* — Jason Mikus
(74) *Attorney, Agent, or Firm* — Brinks Gilson & Lione

(57) ABSTRACT

The disclosure relates to a blower assembly having a blower housing, an impeller adapted for rotation about an axis A-A disposed in blower housing, and an intake plenum cooperating with the interior first surface of the blower housing to define an air entrance passage for receiving an incoming air flow. The intake plenum includes means to split the incoming air flow into a plurality of air streams and direct the air streams to predetermined portions of the impeller susceptible to stall conditions as the impeller rotates about the axis A-A. The means to split the incoming air may include a splitter plate disposed in the air entrance passage or at least one port defined in a portion of the air intake plenum adjacent the impeller.

8 Claims, 9 Drawing Sheets

(56) References Cited

U.S. PATENT DOCUMENTS

| | | | | |
|---|---|---|---|---|
| 7,699,587 | B2 | 4/2010 | Chapman et al. | |
| 7,972,110 | B2 * | 7/2011 | Seki | F04D 29/4226 415/204 |
| 2004/0253098 | A1 | 12/2004 | Hancock | |
| 2005/0217624 | A1 * | 10/2005 | Gunter | F04D 29/4213 123/184.21 |
| 2013/0052001 | A1 | 2/2013 | Su et al. | |

* cited by examiner

LOW POWER AND LOW NOISE FAN-SCROLL WITH MULTIPLE SPLIT INCOMING AIR-STREAMS

CROSS-REFERENCE TO RELATED APPLICATION

This application claims the benefit of U.S. Provisional Patent Application Ser. No. 61/782,092 for a "Low Power and Low Noise Fan-Scroll with Strategic Flow Control and Selective Targeting of Fan with Multiply Split Incoming Air Stream" filed on Mar. 14, 2013, which is hereby incorporated by reference in its entirety.

TECHNICAL FIELD OF INVENTION

The present invention relates to a centrifugal blower assembly for a heating, ventilation, and air-conditioning (HVAC) module for a motor vehicle; more specifically, to the air entrance of a centrifugal blower assembly for a HVAC module.

BACKGROUND OF INVENTION

Heating, ventilation, and air-conditioning (HVAC) modules for automotive applications are known to use centrifugal blower assemblies. A centrifugal blower assembly typically includes an impeller disposed within a blower housing. The impeller is defined by a hub having a series of radially disposed and axially extending fan blades. An air flow space is defined between the outer edges of the fan blades and the interior surfaces of the blower housing. The shaft of an electric motor is attached to the center of the hub and the motor is operative to rotate the impeller at varying speeds. The electric motor rotates the blower at a predetermined speed causing the fan blades to pull in outside air in an axial direction toward the center of the blower housing and then forces the air radially outward out of the blower housing and through the HVAC module.

At certain speeds of rotation of the impeller during normal operation, a large sector of fan blades may be subjected to blade stall, resulting in reduced blower efficiency. During stall conditions, the air flow separates from the fan blades resulting in eddies downstream close to the impeller hub and upstream close to the fan edges. The reversing of the air flow through stalled blades results in turbulent flow and significant noise production Based on the foregoing, there is need for centrifugal blow assembly that has a reduced susceptibility for stall conditions, greater efficiency of energy transfer, and lower noise generation.

SUMMARY OF THE INVENTION

The present invention provides a centrifugal blow assembly having a blower housing, an impeller adapted for rotation about an axis A-A disposed in the blower housing, and an intake plenum cooperating with the interior first surface of the blower housing to define an air entrance passage for receiving an incoming air flow. The intake plenum includes means to split the incoming air flow into a plurality of air streams and direct the air streams to predetermined portions of the impeller that are susceptible to stall conditions as the impeller rotates about the axis A-A. The means to split the incoming air flow may include a splitter plate disposed in the air entrance passage or at least one port defined in a portion of the air intake plenum adjacent the impeller.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
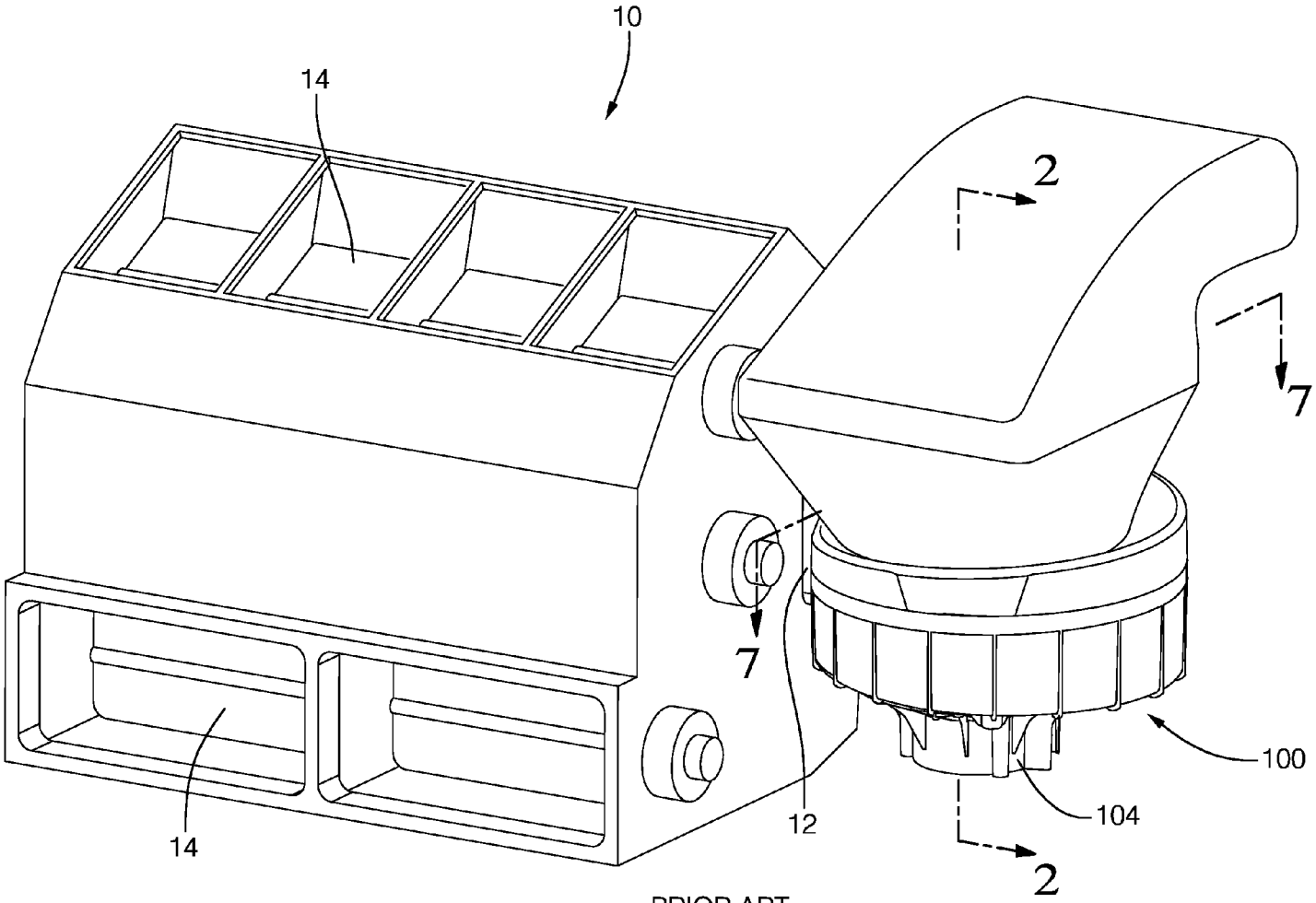
PRIOR ART FIG. 1
FIG. 1 is a perspective view of a prior art HVAC module having a centrifugal blower assembly.
Figure 2:
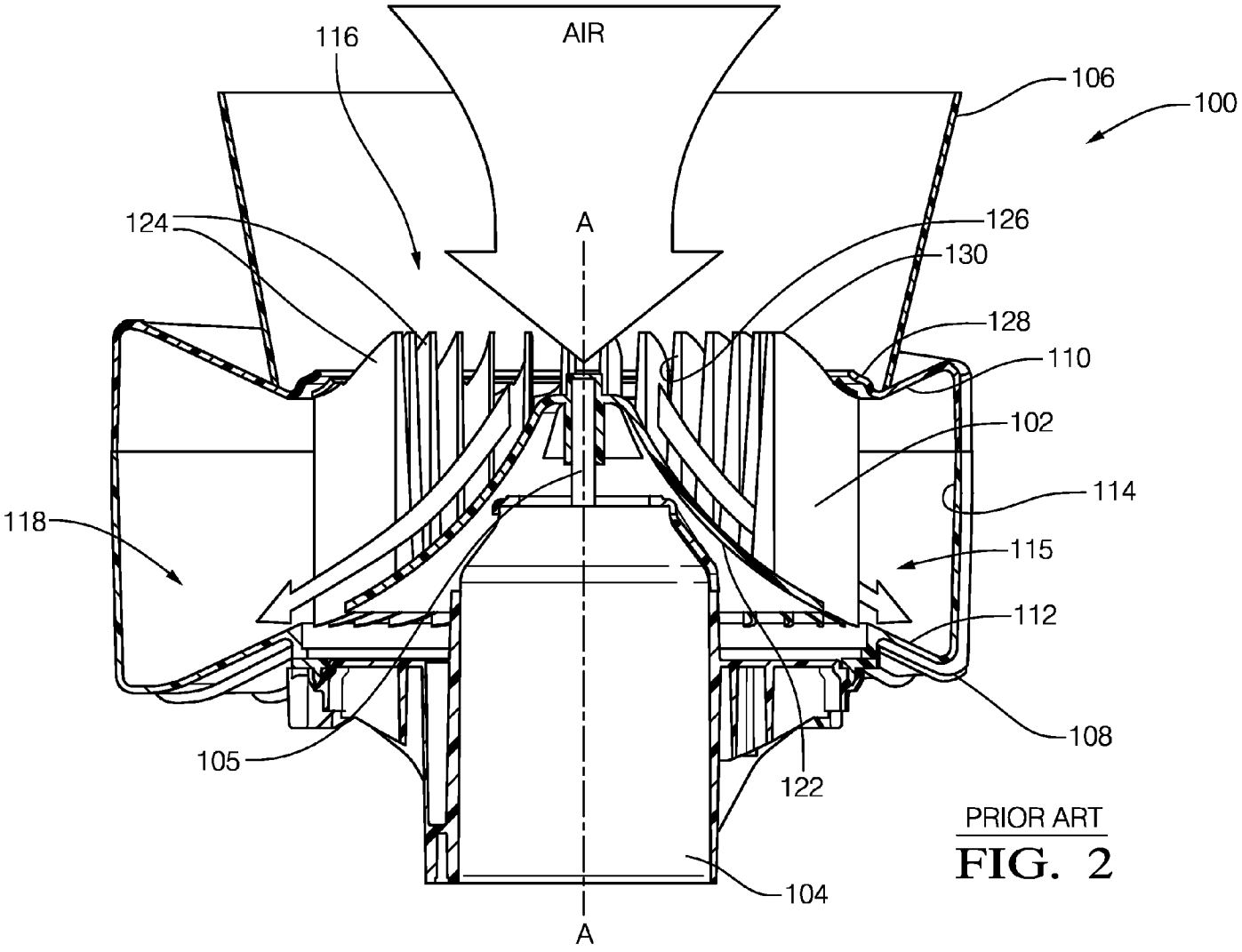
PRIOR ART FIG. 2
FIG. 2 is a cross-sectional view of the prior art centrifugal blower in FIG. 1 along line 2-2.
Figure 3A:
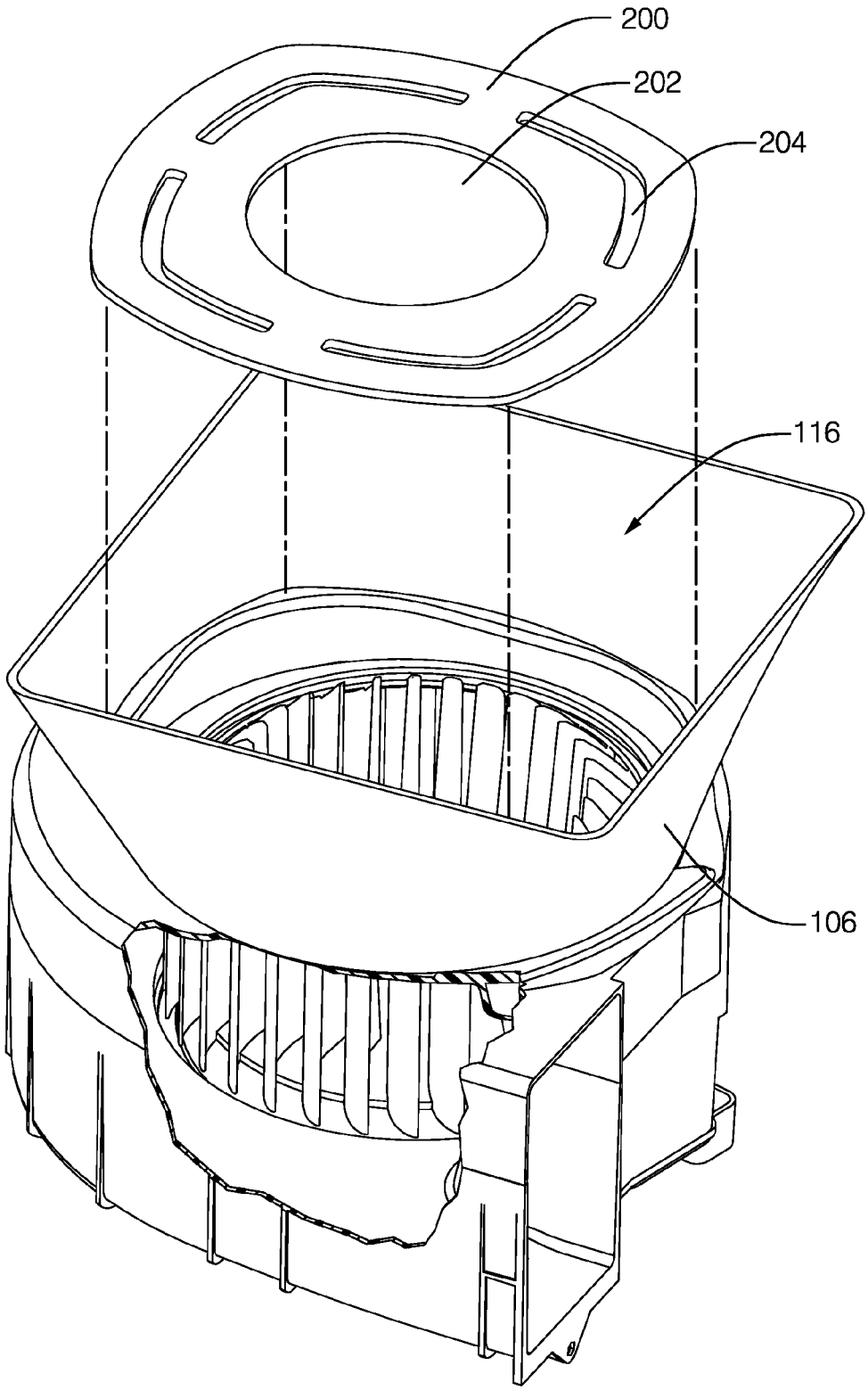
FIG. 3A is a cutaway perspective view of an embodiment of a centrifugal blower assembly of the present invention having a splitter plate spaced from the intake plenum.
Figure 3B:
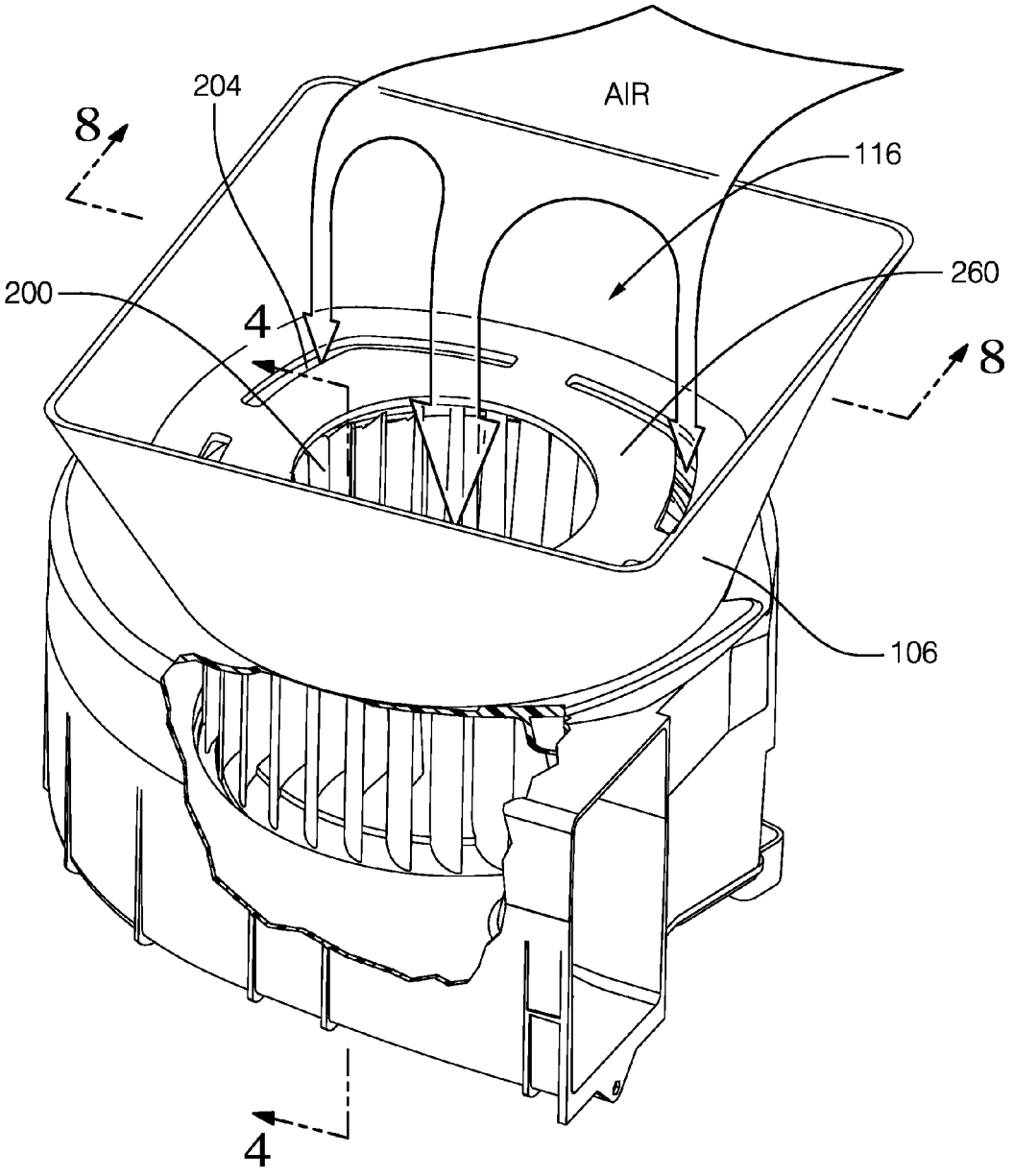
FIG. 3B is a cutaway perspective view of the centrifugal blower assembly of FIG. 3A.
Figure 4:
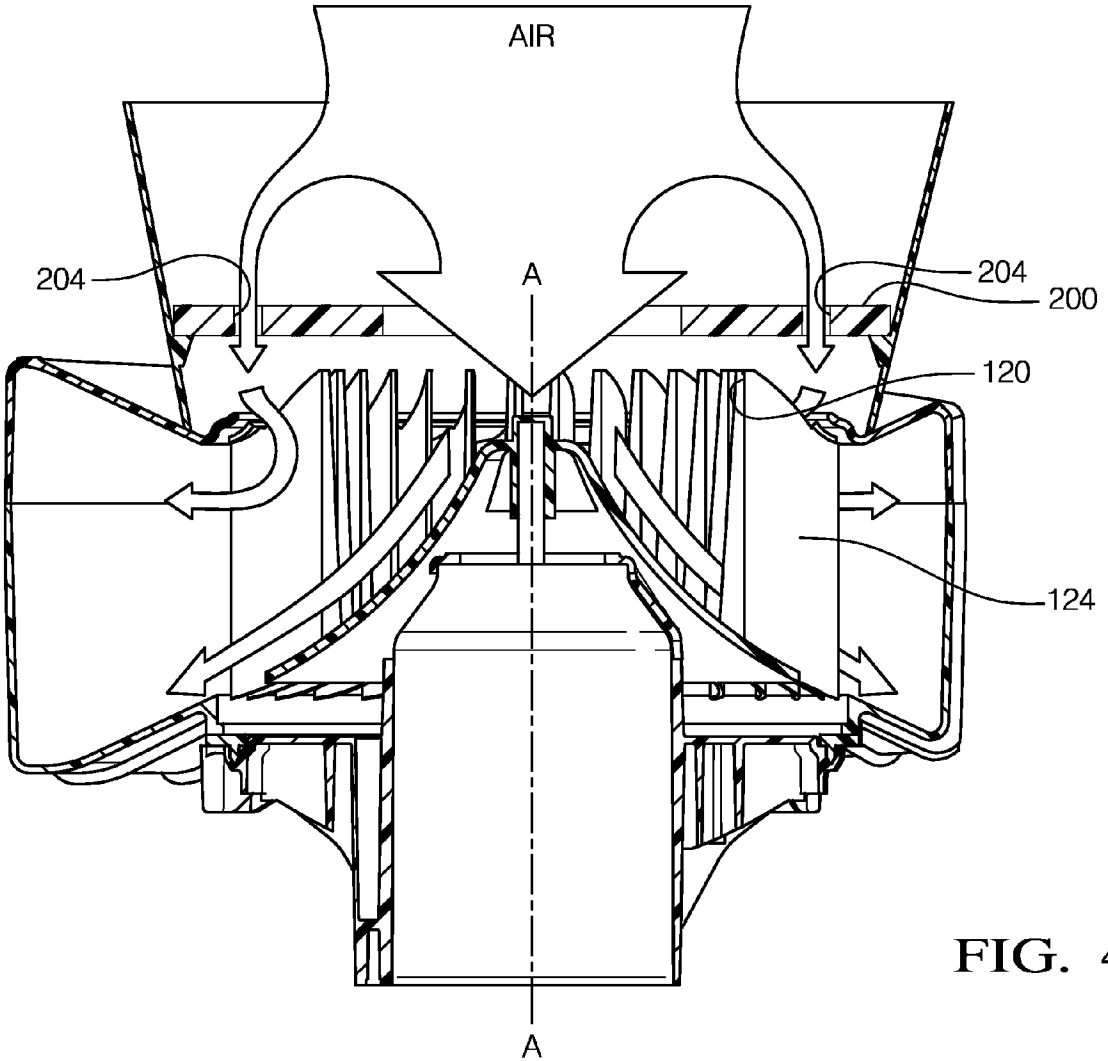
FIG. 4 is a cross-sectional view of the centrifugal blower assembly of FIG. 3B along line 4-4 of FIG. 3B.

In reference to FIGS. 1 through 9, like numerals indicates like or corresponding parts throughout the several views. Shown in FIGS. 1 and 2, is atypical HVAC module 10 having a centrifugal blower assembly 100. The HVAC module 10 includes an inlet 12 for receiving a stream of air flow from the blower assembly 100, a labyrinth of passageways for directing the air flow through the HVAC module 10, at least one internal heat exchanger assembly for conditioning the air flow, and a plurality of air outlets 14 for distributing the conditioned airflow to the passenger compartment of the vehicle. The blower assembly 100 includes an impeller 102 and an electric motor 104 to spin the impeller 102 about a central axis A-A to draw in an airflow through an intake plenum 106 and to push the air flow through the HVAC module 10 to the passenger compartment.

Referring to FIG. 2, shown is a cross section of a prior art centrifugal blower assembly 100 of FIG. 1 along line 2-2. At the heart of the centrifugal blower assembly 100 is an impeller 102 disposed within a cavity defined by a blower housing 108. The blower housing 108 includes an upper interior first wall surface 110, a bottom interior second wall surface 112 oriented toward the first wall surface 110, and an interior side wall surface 114 connecting the first wall surface 110 and second wall surface 112. The interior first wall surface 110 is engaged to and cooperates with an intake plenum 106 to define an air entrance passage 116. Shown in FIG. 7, the interior side wall surface 114 moves progressively away from the center axis A-A of the impeller 102 and cooperates with the perimeter edge of the impeller 102 to define a volute air flow space 115. The volute air flow space 115 transitions into an air exit passage 118 that extends in a radial direction that is tangential to the blower housing 108 and perpendicular to the air entrance passage 116. A cutoff region 120 is defined adjacent the transition point between the interior side wall 114 nearest the impeller 102 and the air exit passage 118. The terms "bottom", "upper", and "horizontal" are arbitrary, as the blower housing 108 could be in any orientation.

The impeller 50 is defined by a central hub 122 having a series of fan blades 124 disposed radially on a perimeter surface of the hub 122. Each of the fan blades 124 includes an interior edge 126 facing the hub 122, an exterior edges 128 facing away from the hub 122, and a distal edge 130 extending from the hub 122 in a direction toward the air entrance passage 116. The center of the hub 122 is attached to a shaft 105 of an electric motor 104 operative to rotate the impeller 102 at varying speeds. The impeller 102 and blower housing 108 may be made of any molded plastic material known in the art.

Figure 7:
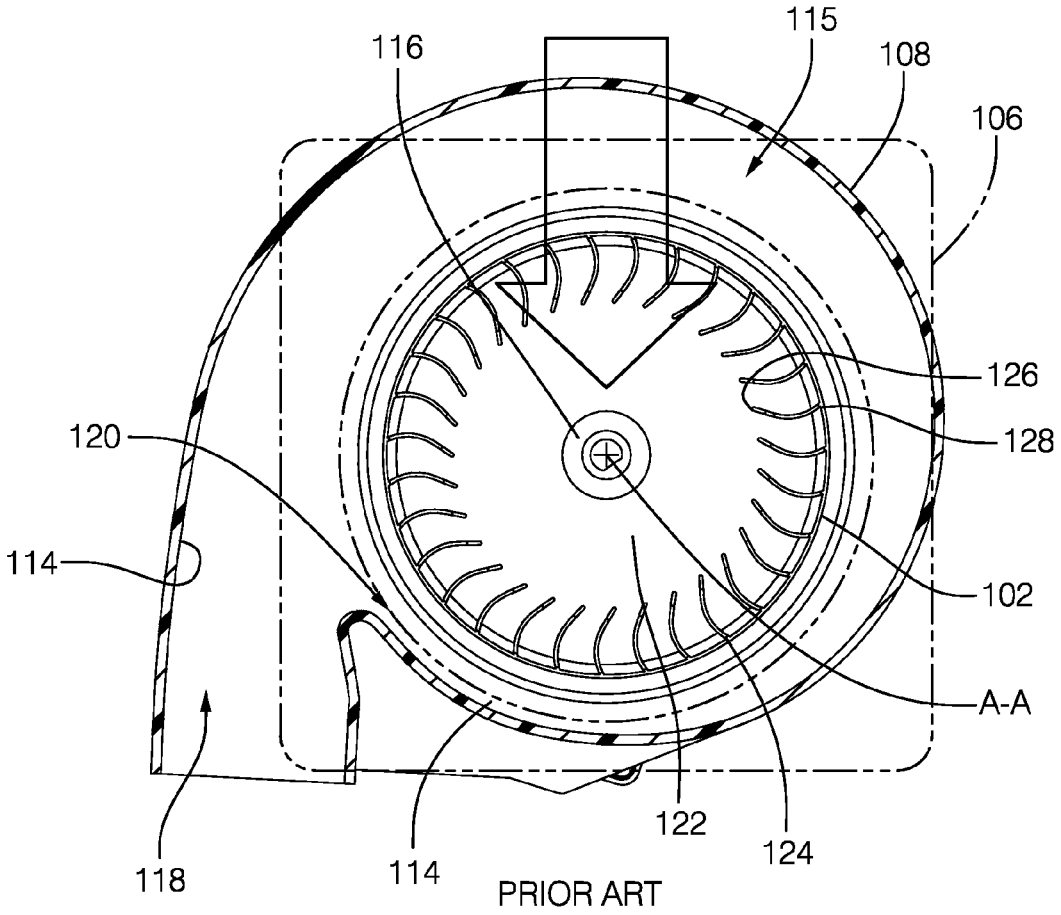
PRIOR ART FIG. 7
FIG. 7 is a cross-sectional view of the prior art centrifugal blower assembly of FIG. 1 along line 7-7.
Figure 8:
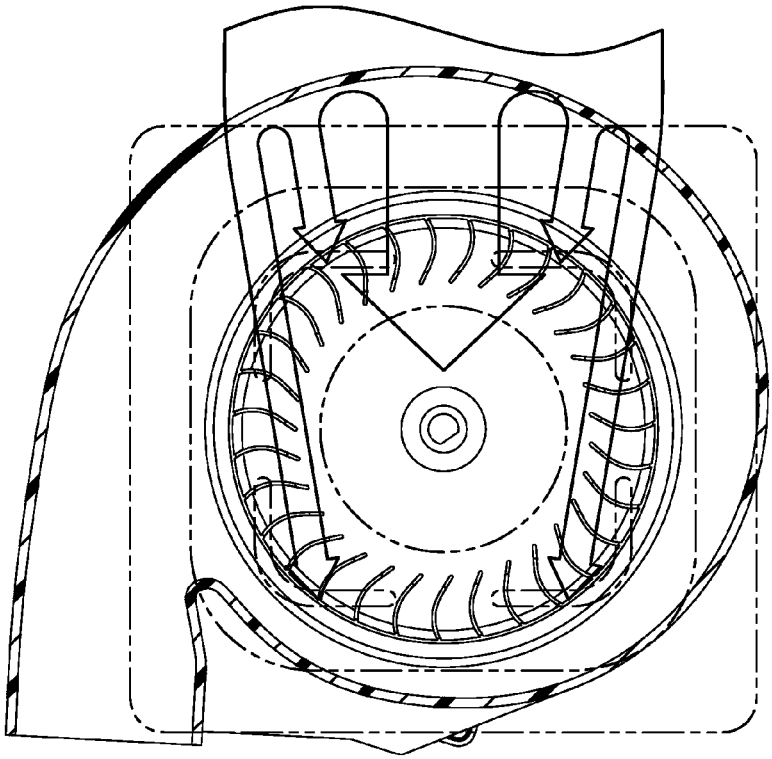
FIG. 8 is a cross-sectional view of the centrifugal blower assembly of FIG. 3B along line 8-8.

Referring to the prior art centrifugal blower assembly 100 shown in FIGS. 2 and 7, as the motor rotates the impeller 102, the fan blades 124 spinning about the axis A-A draw air in a downward axial direction through the air entrance passage 116 toward the center of the impeller 102 and then forces the air radially outward through the volute air flow space 115 before exiting the air exit passage 118. Due to the dynamics of the incoming axial air flow with the blower housing 108 and impeller 102, the incoming axial air flow may not be uniformly distributed amongst all the fan blades 124 of the rotating impeller 102, resulting in near stall conditions, especially around the cutoff region 120. In other words, air flow may not be uniformly distributed about the circumference of the rotating impeller 102, thereby causing stall conditions.

Also, due to the dynamics of the incoming axial air flow with the blower housing 108 and impeller 102, the incoming axial air flow may not be uniformly loading the entire length of each fan blade 124. A greater mass amount of air flow loads the portion of the fan blade 124 nearest the hub 122 and a lesser mass amount of air flow loads the portion of the fan blade 124 nearest the distal edge 130. The non-uniform loading of air onto the full length of the fan blades 124 significantly impairs the fan's ability to transfer energy into the incoming air stream. The non-uniform distribution of the air flow to the circumference of the impeller 102 and the non-uniform loading of the air flow onto the full length of each fan blades 124 result in reduced efficiency of the impeller 102 and increase in operating noise.

Referring to FIGS. 3A, 3B, 4, 5, 6, 8 and 9 the improvement is to partition, or split, the incoming air flow into a plurality of discrete air flow streams in the intake plenum 106 and strategically direct the air flow streams into regions of the impeller 102 susceptible to stalling and onto specific portions along the lengths of the fan blades 124 to achieve a more uniform loading of each fan blade 124. The incoming air flow to the intake plenum 106 may be split into a primary air flow stream to be fed into the impeller 102 in the usual matter and at least one auxiliary stream to target the region of the impeller 102 susceptible to stalling, such as the cutoff region 120. Alternatively, the incoming air flow to the intake plenum 106 may be split into a plurality of auxiliary streams. The smaller auxiliary streams may be individually directed and metered to meet the demand of the specific regions of the impeller 102 and the individual fan blades 124.

Figure 9:
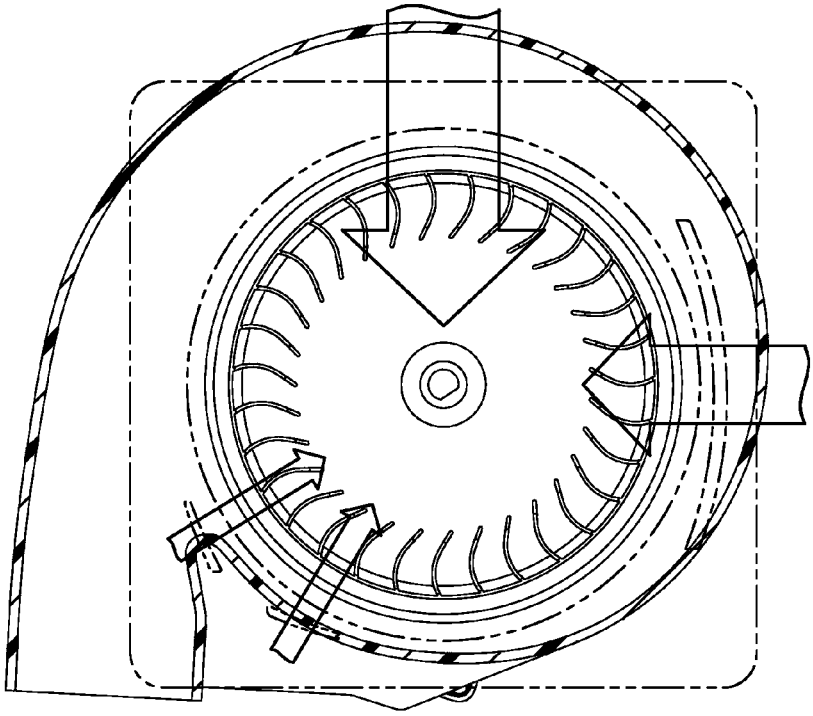
FIG. 9 is a cross-sectional view of the centrifugal blower assembly of FIG. 5 along line 9-9.

Referring to FIGS. 3A, 3B, 4, and 8, a splitter plate 200 may be placed in the intake plenum 106 to split and direct the incoming air flow to the cutoff region 120 and distal ends 130 of the blades 124 nearest the intake plenum 106 to uniformly distribute the air flow and to maximize the air loading on the individual fan blades 124 to reduce stalling and increase efficiency. The primary air flow stream enters the impeller 102 in the axial direction toward the center of the impeller 102 in the traditional manner; however, the auxiliary streams of air flow may be directed to the cutoff region 120 as shown in FIG. 9 and to target the distal ends 130 of the impeller 102, preferably in a cross-flow direction that is substantially perpendicular to the primary air flow stream. As an alternative, the incoming air flow may be split into a plurality of auxiliary streams, in which the auxiliary steams would be directed and metered onto substantially the whole circumference of the impeller 102 to ensure uniform distribution.

The splitter plate 200 may include a central opening 202 sized to reduce the mass of airflow toward the center of the impeller 102 and at least one periphery openings 204 disposed adjacent the perimeter of the splitter plate 200 to target the circumference of the impeller 102 and distal ends 130 of the fan blades 124. The periphery openings 204 may be channeled through the splitter plate 200 in a direction to direct an auxiliary stream of air flow substantially perpendicular to the primary flow. It is preferable to position the splitter plate 200 within about 0.5 times the diameter of the impeller 102 away from the distal ends 130 of the blades 124. For a typical blower assembly used in an automobile, 0.5 mm may be about the max distance desirable, best location is about 0.1-0.2 times the impeller diameter.

Figure 5:
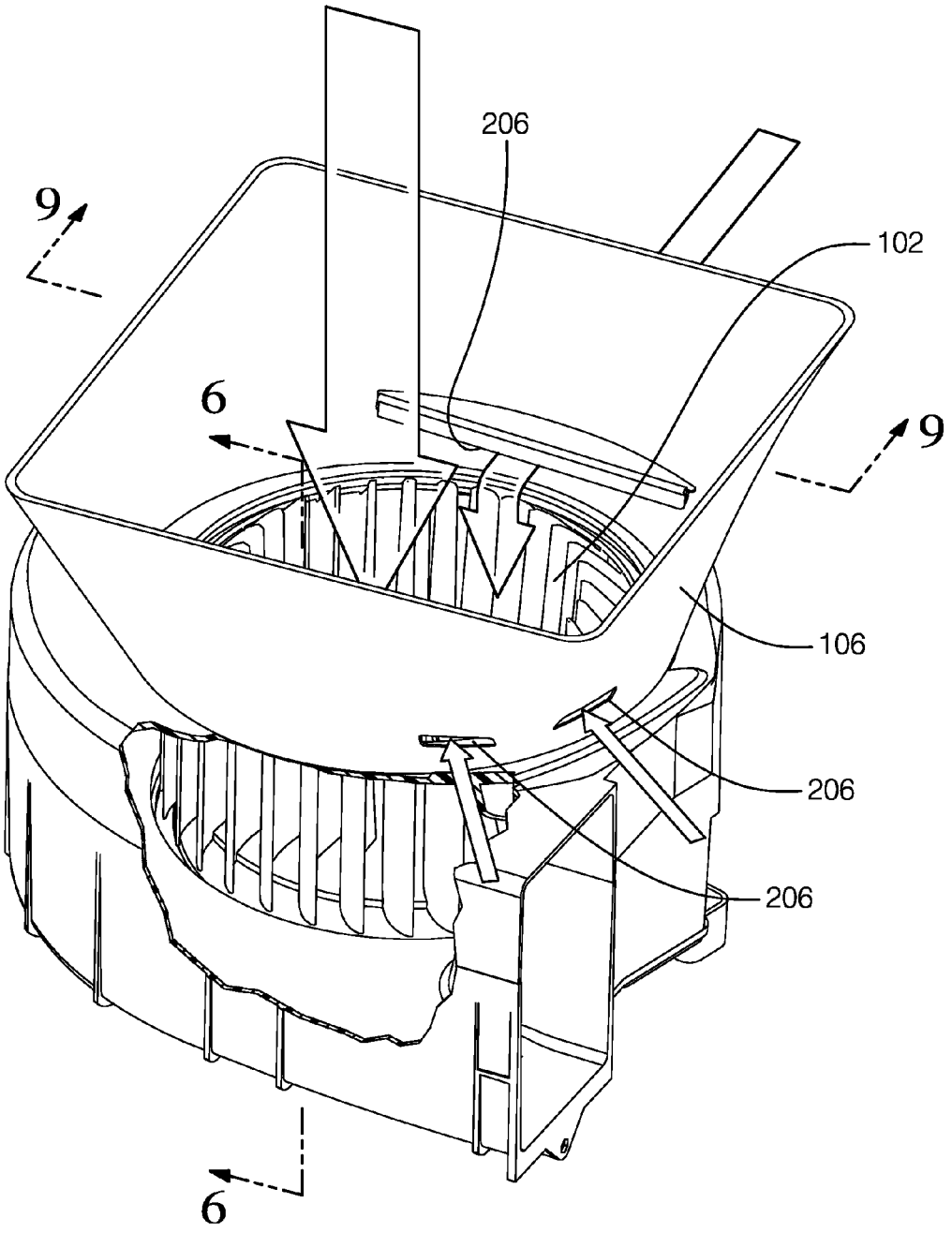
FIG. 5 is a cutaway perspective view of an alternative embodiment of a centrifugal blower of the present invention.
Figure 6:
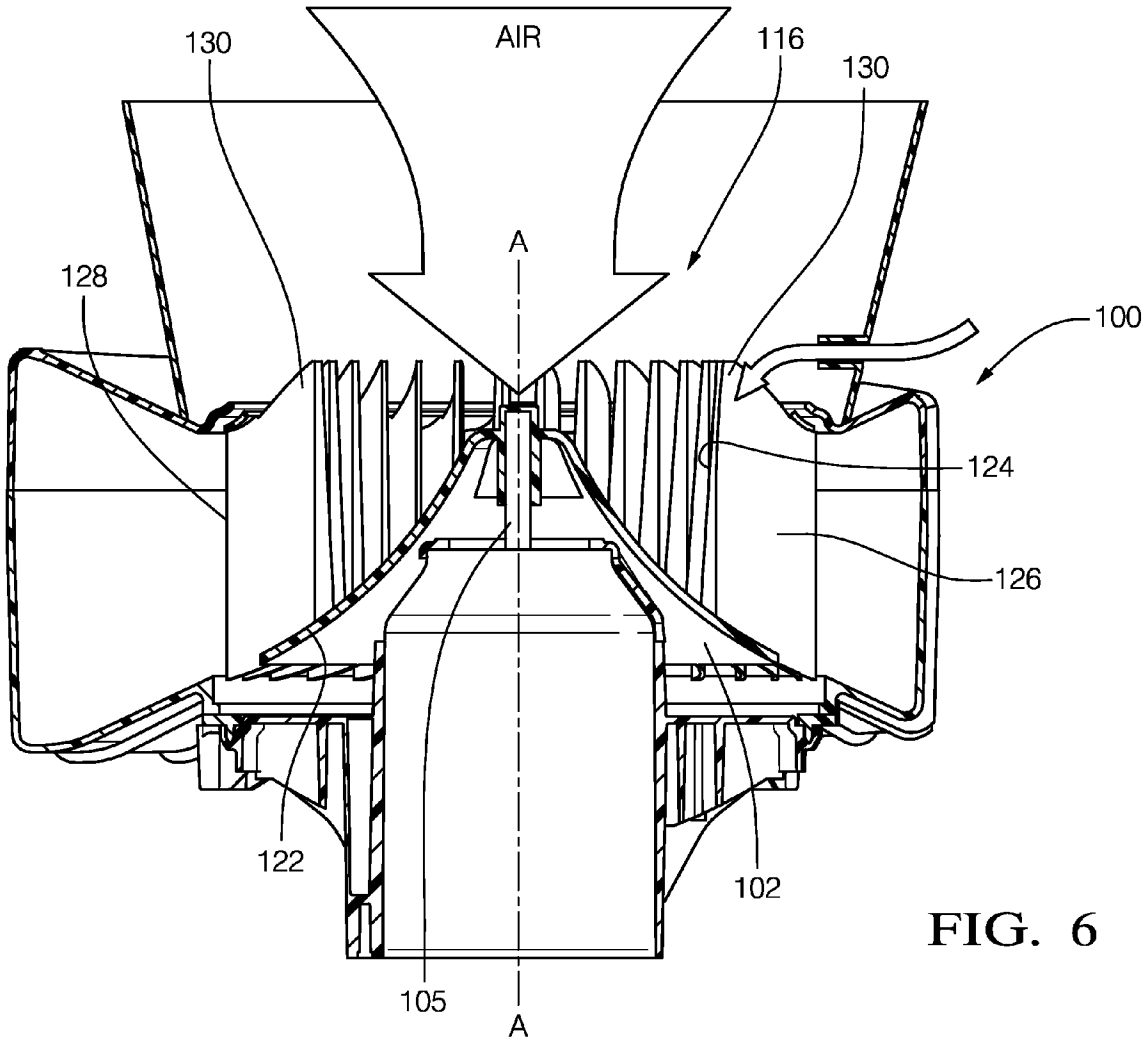
FIG. 6 is a cross-sectional view of the centrifugal blower assembly of FIG. 5 along line 6-6.

Referring to FIGS. 5, 6, and 9, another alternative is to reduce the mass-flow rate of the incoming air flow toward the air entrance and provide ports 206 at strategic locations in the walls of the intake plenum 106 to provide auxiliary streams of air flow directly into the air entrance passage 116 adjacent to the impeller 102. A panel door or gate may be used to meter, or control, the volume of air through the port 206. It is beneficial for the auxiliary streams of air flow to enter immediately adjacent the impeller 102 through the ports 206 in the intake plenum 106 because the auxiliary stream would bypasses all the cumulative upstream resistances of the cowl, which causes about 35% of total system pressure drop, the air-inlet 12 of the blower assembly 100, which causes about a 10% of total system pressure drop, and the filter, which causes about 20-25% of total system pressure drop. It is preferable for the auxiliary stream of air flow to be approximate 50% of total airflow entering the air entrance passage 116 above the impeller 102 to extract significant amount of positive fan work. In very compact designs where access from all 360 degree angle is limited, it is preferable for the auxiliary stream of air to impact approximately from about 35 percent or about 120 degree sector of the fan, circumferentially.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the intentions without departing from the essential scope thereof. Therefore, it is intended that the invention not be limited to the particular embodiment disclosed as the best mode contemplated for carrying out this invention, but that the invention will include all embodiments falling within the scope of the appended claims.

Having described the invention, it is claimed:

1. A blower assembly comprising:

a blower housing having an interior first surface;

an impeller with a central hub and fan blades adapted for rotation about an axis A-A disposed in the blower housing, wherein the fan blades include distal edges extending in a direction axially away from the central hub; and an intake plenum cooperating with the interior first surface of the blower housing to define an air entrance passage for receiving an incoming air flow;

wherein the intake plenum includes a central primary circular opening and at least one auxiliary opening arranged radially outward from the primary circular opening to split the incoming air flow into a plurality of air streams and direct the air streams to predetermined portions of the impeller as the impeller rotates about the axis A-A, wherein the at least one auxiliary opening directs at least one of the air streams toward the distal edges of the fan blades, wherein the central primary circular opening and the at least one auxiliary opening are formed in a splitter plate disposed in the air entrance passage and extending transverse to the axis A-A, wherein the splitter plate extends from the central primary circular opening in a direction transverse to axis A-A to the at least one auxiliary opening.

2. The blower assembly of claim 1, wherein the predetermined portions of the impeller are portions of the impeller subject to stall conditions as the impeller rotates about the axis.

3. The blower assembly of claim 1, wherein:

the impeller includes a plurality of fan blades extending from a perimeter surface of a central hub, wherein at least one of the fan blades includes a distal edge extending in a direction axially away from the central hub;

the predetermined portions of the impeller include a portion of the fan blade immediately adjacent the distal edge.

4. The blower assembly of claim 3, wherein the predetermined portions of the impeller includes a portion of the fan blade immediately adjacent the central hub.

5. The blower assembly of claim 3, wherein the predetermined portions of the impeller includes a portion of the fan blade between the distal edge and the central hub.

6. The blower assembly of claim 3, wherein the blower housing further includes:

an interior side wall moving progressively away from the center axis A-A of the impeller to define a volute air flow space leading to an air exit passage extending in a radial direction tangential to the blower housing; and a cutoff region defined adjacent a transition point between the interior side wall nearest the impeller and the air exit passage;

wherein the predetermined portions of the impeller includes a plurality of the blades as it rotates in a vicinity past the cutoff portion.

7. The blower assembly of claim 1, wherein the central opening is configured to permit an axial flow of air to the hub of the impeller and the at least one auxiliary opening is configured to provide a cross-flow of air stream with respect to the axial flow of air to a portion of the fan blade immediately adjacent the distal edge.

8. The blower assembly of claim 1, wherein the at least one auxiliary opening is a plurality of auxiliary openings that circumscribe the perimeter of the impeller.

* * * * *